United States Patent [19]

Irie et al.

[11] 4,368,084

[45] Jan. 11, 1983

[54] METHOD FOR PRODUCING COLD ROLLED STEEL SHEETS HAVING A NOTICEABLY EXCELLENT FORMABILITY

[75] Inventors: Toshio Irie, Chiba; Susumu Sato, Ichihara; Osamu Hashimoto, Chiba, all of Japan

[73] Assignee: Kawasaki Steel Corporation, Kobe, Japan

[21] Appl. No.: 267,930

[22] Filed: May 28, 1981

[30] Foreign Application Priority Data

May 31, 1980 [JP] Japan ..... 55-73179
Jul. 30, 1980 [JP] Japan ..... 55-103666

[51] Int. Cl.[3] ..... C21D 8/06; C21D 9/48

[52] U.S. Cl. ..... 148/12 C; 148/12 D; 148/36

[58] Field of Search ..... 148/12 C, 12 D, 12 F, 148/36; 75/123 J

[56] References Cited

U.S. PATENT DOCUMENTS 3,988,174 10/1976 Kawano ..... 148/36
4,046,601 9/1977 Hook ..... 148/36
4,339,284 7/1982 Hashimoto et al. ..... 148/12 C

*Primary Examiner*—Peter K. Skiff
*Attorney, Agent, or Firm*—Balogh, Osann, Kramer, Dvorak, Genova & Traub

[57] ABSTRACT

Non-ageing cold rolled steel sheets having a very excellent formability are produced by hot rolling a steel consisting of not more than 0.008% of C, not more than 0.20% of Si, 0.04–0.30% of Mn, not more than 0.03% of P, 0.01–0.10% of Al, a content of Al being more than N%×4, not more than 0.02% of S, not more than 0.01% of N, 0.01–0.07% of Nb, a content of Nb being C%×3−{C%×8+0.02}%, and the remainder being substantially Fe, at a total reduction of not less than 90%, a rolling speed of not less than 40 m/min in the finishing rolling and a finishing temperature of not lower than 830° C., coiling the hot rolled strip at a temperature of 600°–800° C., cold rolling the coiled strip following a conventional manner to obtain a cold rolled strip having final gauge and then continuous annealing or hot-dip galvanizing the cold rolled strip within a temperature range of 700°–900° C. for 10 seconds–5 minutes.

8 Claims, 3 Drawing Figures

METHOD FOR PRODUCING COLD ROLLED STEEL SHEETS HAVING A NOTICEABLY EXCELLENT FORMABILITY

BACKGROUND OF THE INVENTION

The present invention relates to a method for producing non-ageing cold rolled steel sheets having a noticeably excellent formability.

Outer panels and inner panels of automobiles are subjected to high press forming, so that non-ageing cold rolled steel sheets having a high $\bar{r}$ value and a large elongation have been used. In particular, for fenders, quarter panels and oil pans have been used decarburized and denitrogenized steel sheets produced through open coil annealing and Ti killed extra low-carbon steel sheets but the former is high in the production cost and large in the grain size and low in the strength, so that upon press forming, skin roughness referred to as orange peel and wall break are apt to be caused. Furthermore, in the latter Ti killed steel sheets, Ti has a strong bonding force to not only C and N but also S and O, so that in order to ensure the non-ageing property, Ti must be added in an amount of several times of the stoichiometric equivalent with respect to C and N and the formed titanium sulfide and oxide become non-metallic inclusions and a large number of surface defects referred to as sleever are formed.

As an improved method, it has been proposed that C and N are fixed by Nb or Nb and Al, instead of Ti and the ageing property and $\bar{r}$ value are improved, and for example, Met, Trans. 1972, vol. 3, pp. 2171–2182 discloses that when Mn and Al are compounded in sufficient amounts to fix S and N respectively in steel, if Nb is contained in a sufficient amount to form NbC stoichiometrically with respect to C, that is 0.071% of Nb per 0.009% of C, non-ageing steel can be obtained by annealing at 700° C. within 4 hours after cold rolling and if 0.177% of Nb per 0.014% of C is contained, even when annealing is effected at 870° C. after cold rolling, no yield elongation occurs.

U.S. Pat. No. 3,761,324 discloses that when 0.068–0.25% of Nb is added to steel containing 0.002–0.20% of C and Mn in a sufficient amount to S, if Nb which is not bonded to C and N, is present in an amount of more than 0.025%, $\bar{r}$ value reaches more than 1.8. Examples in this patent show that non-ageing steel sheets having a $\bar{r}$ value of 1.78–2.10 and an elongation of 40–48% can be obtained by hot rolling and cold rolling a material containing 0.005–0.01% of C, about 0.006% of N, 0.015–0.020% of Al and 0.08–0.12% of Nb and then annealing the thus treated sheet at 700° C. for 1–16 hours.

Other than the above described methods, a plurality of methods wherein Nb alone is added without using Al, have been proposed but any method naturally needs a larger amount of Nb than the above described two methods in order to obtain non-ageing steel sheets and the formability is poor.

Thus, the previously proposed Nb added steels are non-ageing cold rolled steel sheets having a $\bar{r}$ value of 1.6–2.1 and an elongation of 40–48% obtained by adding 0.07–0.18%, preferably 0.08–0.12% of Nb to extra low-carbon steel containing 0.005–0.02% of C but have the following defects.

(1) These steel sheets have an elongation of 40–48%, which is lower than the elongation of 50–54% of decarburized and denitrogenized steel sheets.

(2) Nb is an expensive metal and the cost is necessarily increased by the addition of a large amount of Nb.

An object of the present invention is to provide a method for producing non-ageing cold rolled steel sheets, in which the drawbacks of the previously known methods are obviated and improved.

In order to prolong the durable life of thin steel sheets used for outer panels of automobiles, the demand of steel sheets on which a coating is applied, has been increased. For this coating, a variety of processes have been developed but in view of the production cost and the properties thereof, a continuous hot-dip galvanizing process is one of the most excellent processes.

Since the outer panels and inner panels of automobiles are subjected to the high press forming, non-ageing galvanized steel sheets having a high $\bar{r}$ value and a large elongation are necessary. The method for producing the galvanized steel sheets to be used for such an object involves (1) a method wherein cold rolled low-carbon steel sheets are plated by usual step, that is continuous annealing-continuous plating and then subjected to over ageing treatment to obtain non-ageing steel sheets (Japanese Patent Application Publication No. 74/72), (2) a method wherein carbide-forming elements which do not retard the plating ability, such as Nb are added to a steel material in addition to Ti, whereby non-ageing steel sheets are obtained (Japanese Patent Laid-Open Application No. 35,616/78) and the like but these methods cannot provide the satisfactory drawing property, that is high elongation high and $\bar{r}$ value.

Another object of the present invention is to provide a method for producing galvanized steel sheets having a very high $\bar{r}$ value and a high elongation, an excellent deep drawing property, that is substantially non-ageing property and an excellent surface property.

BRIEF DESCRIPTION OF THE DRAWINGS

For better understanding of the invention, reference is taken to the accompanying drawings, wherein.

DESCRIPTION OF THE PREFERRED EMBODIMENTS

The present invention will be explained in more detail with respect to the experimental data.

Slabs wherein the contents of C and Nb are varied as shown in the following Table 1 were hot rolled under the following conditions of a total reduction of 90% and a lowest rolling speed of 70 m/min in the finishing strip mill, a finishing temperature of 870° C., a coiling temperature of 680° C. and then cold rolled at a reduction of 80% to obtain cold rolled sheets having a final gauge and the cold rolled sheets were continuously annealed at 830° C. for 40 seconds. The relation of the properties (AI value, El value and $\bar{r}$ value) to parameter $\alpha \equiv Nb(\%)/C(\%)$ and parameter $\beta \equiv Nb(\%) - 8C(\%)$ is shown in FIGS. 1 and 2.

TABLE 1

| C | Si | Mn | P | S | O | sol Al | Total N | Nb | $\alpha$ | $\beta$ |
|---|---|---|---|---|---|---|---|---|---|---|
| 0.003% to 0.010% | not more than 0.03% | not more than 0.20% | not more than 0.03% | not more than 0.01% | not more than 0.005% | 0.021% to 0.048% | 0.0037% to 0.0048% | 0.010% to 0.10% | 1.6 to 18.4 | −0.051% to 0.033% |

Figure 1:
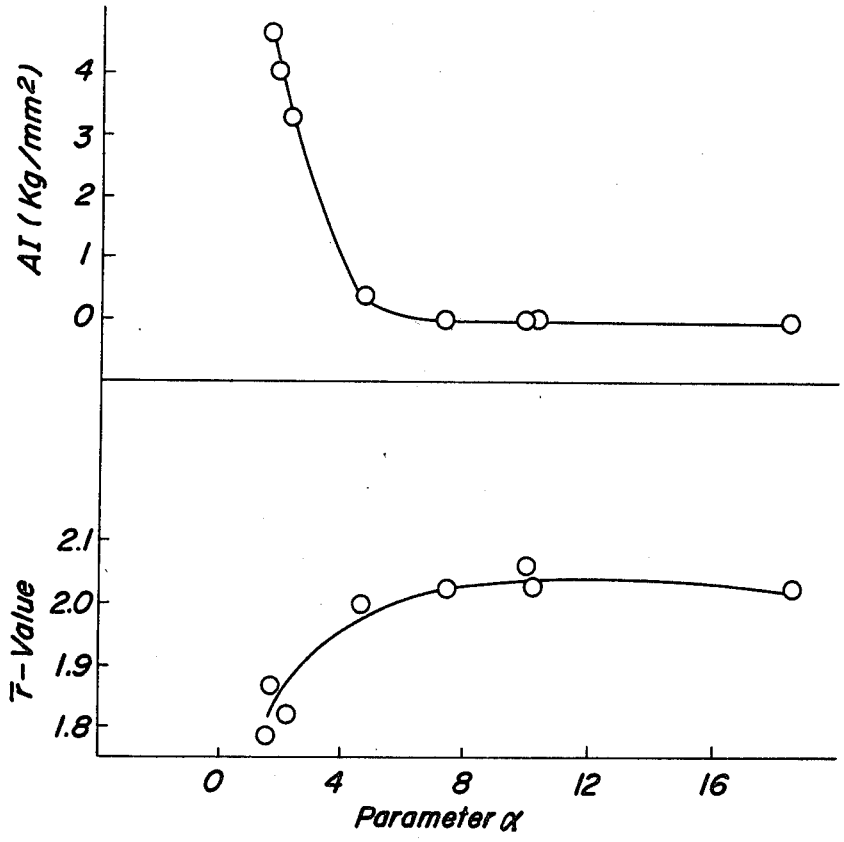
FIG. 1 is a view showing the relation of AI value and $\bar{r}$ value to the parameter $\alpha$ in the steel sheets.
Figure 2:
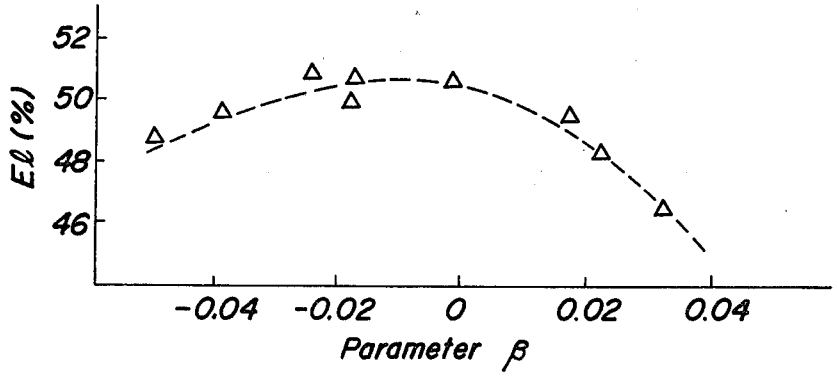
FIG. 2 is a view showing the relation of El(%) to the parameter $\beta$ in the steel sheets.

As seen from FIG. 1, when the parameter $\alpha$ is more than 3, AI value, that is the ageing index is less than 1 kg/mm$^2$ and the $\bar{r}$ value is more than 1.9 and completely non-ageing steel sheets having a high $\bar{r}$ value are obtained. FIG. 2 shows that El value (elongation) is varied in accordance to the parameter $\beta$ and when $\beta$ is less than 0.02%, the satisfactorily high value is obtained.

From this experiment, it is concluded that Nb is necessary to be more than 3 times based on C(%) but $\beta \equiv Nb(\%) - 8 \times C(\%)$, that is Nb(%) which is not bonded with C, is less than 0.02%.

Within the above described range, it is preferable in view of balance of the whole property values that the content of Nb is not more than 0.06% and also within a range of $4 \times C(\%) - 8 \times C(\%) + 0.010\%$.

When C exceeds 0.008%, the $\bar{r}$ value and elongation considerably lower, so that C must be not more than 0.008% and is preferred to be more than 0.006%, Al must be added in an amount of not less than 0.01% in order to fix N as AlN and more than 4 times of N(%). Otherwise, N in the steel is bonded with Nb in the steel, so that C which is not fixed with Nb remains in a large amount and AI value cannot be satisfactorily reduced. However, the addition of Al of more than 0.1% increases inclusions due to alumina cluster and becomes cause for forming surface defects, so that such an addition should be avoided.

When the content of N is higher, it is necessary to increase the content of Al and therefore when N is more than 0.01%, surface defects are increased owing to the increase of the inclusion due to alumina cluster, so that N should be not more than 0.01%.

A content of Mn may be one contained in usual cold rolled steel sheets and is 0.04–0.30%.

Concerning Si, when the content is higher, the ductility is deteriorated and the plating ability is considerably deteriorated, so that the content of Si must be not more than 0.20%.

Contents of other impurities of P, S, O and the like may be ones contained in usual cold rolled steel sheets similarly to Si and Mn and the content of P, S and O may be 0.030%, 0.020% and 0.008% respectively.

The steel of the present invention can be produced by any one of conventional methods alone or in combination. However, C must be removed in the step for melting steel and for the purpose, it is advantageous to carry out vacuum decarburization treatment through RH process, DH process and the like. Furthermore, it is advantageous to directly melt extra low-carbon steel by means of pure oxygen bottom-blown converter process (Q-BOP process). In addition, conventional ingot forming process or continuous casting process may be used.

A slab produced by a continuous casting process or a slab produced by a conventional slabbing process is subjected to a continuous hot rolling.

According to the present invention, the reduction and the rolling speed in the continuous hot rolling must be limited. Concerning the reduction, the total reduction until a slab is passed through rough rolling and delivered from finishing rolling stand group must be not less than 90%. A rolling speed of the finishing stand group should be 40 m/min in the lowest speed and is preferred to be more than 80 m/min.

When the above described conditions of reduction and rolling speed are satisfied, fine complex precipitates of, for example, less than 1,000 Å presumably consisting of Nb(C,N), AlN and MnS are very densely present and C in steel stably exists around these precipitates, whereby substantially non-ageing steel sheets having an extremely deep drawing property can be obtained.

When the reduction is lower than 90% and the rolling speed is lower than 40 m/min, the above described phenomenon does not occur and non-ageing steel sheets having an extremely deep drawing property cannot be obtained.

According to the present invention, the hot rolling finishing temperature must be not lower than 830° C. When the finishing temperature is lower than this temperature, the $\bar{r}$ value, elongation and ageing property are deteriorated.

In the present invention, the coiling temperature must be 600°–800° C.

Figure 3:
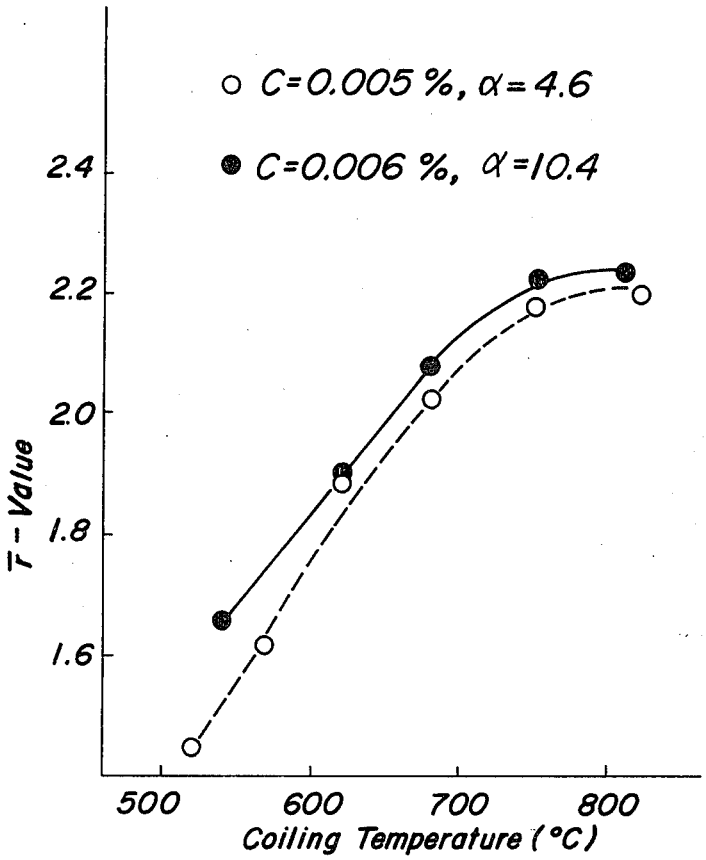
FIG. 3 is a view showing the relation of $\bar{r}$ value to the coiling temperature of the steel sheets.

FIG. 3 shows the relation of $\bar{r}$ value to the coiling temperature when a steel slab having C of 0.005% and $\alpha$ of 4.6 and a steel slab having C of 0.006% and $\alpha$ of 10.4 were hot rolled at a total reduction of 95%, a lowest rolling speed of 70 m/min and a finishing temperature of 870°–900° C., and then coiled at various coiling temperatures, cold rolled at a reduction of about 80% and subjected to continuous annealing at 840° C. for 40 seconds. Unless the coiling temperature is not lower than 600° C., the $\bar{r}$ value is low and the satisfactory deep drawing property cannot be ensured. Even if the coiling is effected at a temperature of higher than 750° C., the raising of $\bar{r}$ value tends to be saturated. When the coiling temperature exceeds 800° C., the formation of scales is increased, so that such a temperature should be avoided. The coiling temperature of 680°–750° C. is most preferable in view of AI value, $\bar{r}$ value and El value.

In order to make the coiling temperature to be within this temperature range, the water cooling after the finishing rolling is weakened or the water cooling is completely omitted.

The thus obtained hot rolled coil is subjected to pickling following to the conventional process to remove scale and then cold rolled, or cold rolled and then subjected to pickling or polishing to remove scale. When the reduction upon cold rolling is less than 60%, the desired $\bar{r}$ value cannot be obtained, while when the reduction exceeds 90%, the $\bar{r}$ value becomes higher but the anisotropy becomes larger, so that in the present invention, the reduction in the cold rolling is preferred to be within a range of 75–85%.

According to the present invention, the thus obtained cold rolled steel strip is further subjected to continuous annealing. The annealing temperature and time are properly selected depending upon the aimed steel qualities within the range of 700°–900° C. and 10 seconds–5 minutes. Within the temperature range of 700°–900° C., the strength is lower at the higher temperature but the $\bar{r}$ value and elongation become higher. The soaking at 780°–880° C. for 30–120 seconds is particularly preferable. The cooling speed after the continuous annealing is not particularly limited but in the case of the composition of $\alpha(\equiv Nb\%/C\%)$ being 3–8, if a slow cooling of less than 10° C./sec is effected to near 700° C. after the soaking, such a treatment is advantageous for improving the qualities, particularly ageing resistance. In the case of a continuous annealing furnace provided with an over ageing furnace, an addition of over ageing treatment to the steels of the present invention does not give any adverse influence upon the steel quality.

The steel sheets according to the present invention may become AI=1–3 kg/cm$^2$ in the state subjected to the continuous annealing and in the usual using condition, AI within this range is a hardly ageing property and can be referred to as the substantial non-ageing property. In this case, more or less yield elongation may be caused concerning the tensile property but this can be overcome by temper rolling at a reduction of less than 2%.

Production of hot-dip galvanized steel sheets may be carried out by heating a cold rolled steel sheet in the same manner as in the above described method for producing the cold steel sheet and then subjecting to galvanizing following to conventional process, and if necessary, subjecting to a galvannealing process, and in this case, it is not necessary to particularly limit the cooling speed.

In the steel sheets of the present invention, AI may become 1–3 kg/cm$^2$ in the galvanized state but if AI is within this range, such a steel sheet has hardly ageing property and is referred to as non-ageing property. In this case, more or less yield elongation may be caused concerning the tensile property, so that it is preferable to carry out temper rolling at a reduction of less than 2% for together correcting the shape.

By hot-dip galvanizing, the $\bar{r}$ value and the elongation can be lowered by 0.1–0.2 and 1–3% respectively as compared with the case where no plating is effected.

The present invention will be explained with respect to the following example of cold rolled steel sheets.

EXAMPLE

(1) Production of Steel

Formation of Slab

Molten steels having the compositions shown in the following Table 2, I and II were obtained through pure oxygen top-blown converter (LD converter) and RH degassing step. A molten steel shown in Table 2, III was obtained through pure oxygen bottom-blown converter (Q-BOP) and RH degassing step.

TABLE 2

| Steel | Composition (checked on cold rolled sheet) (%) | | | | | | | | | |
|---|---|---|---|---|---|---|---|---|---|---|
| No. | C | Si | Mn | P | S | O | Total N | sol Al | Nb | Nb/C |
| I | 0.007 | 0.009 | 0.15 | 0.013 | 0.008 | 0.0042 | 0.0045 | 0.042 | 0.043 | 6.1 |
| II | 0.005 | 0.012 | 0.16 | 0.015 | 0.009 | 0.0038 | 0.0032 | 0.036 | 0.020 | 4.0 |
| III | 0.004 | 0.010 | 0.07 | 0.010 | 0.005 | 0.0027 | 0.0028 | 0.035 | 0.036 | 9.0 |

The degas treating time was 25 minutes in Steel I, 23 minutes in Steel II and 35 minutes in Steel III. Nb and Al were added just before completing the degas treatment. Steels I and III were formed into slabs having a thickness of 220 mm by slabbing process. Steel II was formed into a slab having the same thickness as described above by continuous casting.

(2) Hot Rolling

After the above described slabs were surface treated, the steels I and III were maintained at a uniform temperature of 1,080° C. for 35 minutes and the steel II was maintained at temperature of 1,200° C. for 30 minutes (the temperature was measured at the slab surface). Each slab was continuously rolled through 4 lines of roughers and 7 stands of finishing mill to obtain a hot rolled steel strip having a thickness of 3.2 mm. The reduction when the steel strip was obtained from a sheet bar in the finishing rolling was 92% in the steels I and III and 93% in the steel II respectively. The rolling speed (substantially correspond to the speed of the strip at exit of the roll) in the finishing mill was as follows.

| | | |
|---|---|---|
| Steels I and III: | First stand | 98 m/min |
| | 7th stand | 660 m/min |
| Steel II: | First stand | 103 m/min |
| | 7th stand | 945 m/min |

The finishing temperature was controlled at 890°–920° C. The coiling temperature was 770° C. in the steel I, 660° C. in the steel II and 710° C. in the steel III respectively.

(3) Cold Rolling

Annealing

The hot rolled steel strips were pickled and cold rolled to obtain cold rolled coils having a thickness of 0.7 mm (reduction: 78%) or 0.8 mm (reduction: 75%).

The recrystallization annealing was carried out in a continuous annealing line under the following condition.

Steel I: After soaking at 820°–850° C. for 30 seconds, the heated strip was cooled to 500° C. at a cooling rate of about 45° C./sec and a temperature within a range of 500°–350° C. was maintained for 180 seconds.

Steel II: After soaking at 800°–830° C. for 20 seconds, the heated strip was cooled to 700° C. at a cooling rate of 1.5° C./sec and from 700° C. to room temperature at a cooling rate of about 20° C./sec.

Steel III: After soaking at 840°–870° C. for 40 seconds, the heated strip was cooled to room temperature at a cooling rate of about 25° C./sec.

The annealed coils were subjected to skin pass of 0.3–0.7% to obtain products, the mechanical properties of which are shown in the following Table 3.

TABLE 3

| Steel | Mechanical properties | | | | |
|---|---|---|---|---|---|
| No. | YP (kg/mm$^2$) | TS (kg/mm$^2$) | El (%) | $\bar{r}$ | AI (kg/mm$^2$) |
| I | 18 | 32 | 48 | 2.0 | 2.3 |
| II | 17 | 31 | 50 | 2.1 | 1.6 |
| III | 14 | 28 | 52 | 2.3 | 0 |

As the result of the surface inspection, all the products are equal to general Al killed steel and there is no problem in the practical use.

Thus, it can be seen that the steel sheets of the present invention are excellent in the surface properties and are non-ageing cold rolled steel sheets.

Then, explanation will be made with respect to example of hot-dip galvanized steel sheets. Steels shown in Table 2 were cold rolled through the same steps as in the production of the cold rolled steel sheets to obtain cold rolled steel sheets having a thickness of 0.7 mm and 0.8 mm.

The recrystallization annealing was carried out in a continuous hot-dip galvanizing line under the following condition.

Steel I: Soaking at 830°-860° C. for 40 seconds.
Steel II: Soaking at 780°-820° C. for 25 seconds.
Steel III: Soaking at 860°-880° C. for 60 seconds.

The cooling rate to a plating bath at about 460° C. was 2°-10° C./sec and the steel I was subjected to a galvannealed treatment at 580° C. for 10 seconds after plating.

Plated coils were subjected to skin pass of 0.6-0.7% to obtain products, the mechanical properties and the plating ability of which are shown in the following Tables 4 and 5 respectively.

TABLE 4

| Steel No. | Sheet thickness (mm) | Mechanical property YP (kg/mm²) | TS (kg/mm²) | El (%) | $\bar{r}$ | AI (kg/cm²) |
|---|---|---|---|---|---|---|
| I | 0.8 | 19 | 32 | 47 | 1.8 | 2.2 |
| II | 0.7 | 18 | 31 | 49 | 2.0 | 1.2 |
| III | 0.8 | 15 | 29 | 51 | 2.1 | 0 |

TABLE 5

| Steel No. | Plating process | Surface property | Adherence Bending test | DuPont impact test |
|---|---|---|---|---|
| I | Galvannealing | ⊙ | ⊙ | ⊙ |
| II | Galvanizing | ⊙ | ⊙ | ⊙ |
| III | " | ⊙ | ⊙ | ⊙ |

Note:
The case where there is no problems in naked eye judgement by comparing with low-carbon rimmed steel which has been recognized to be good in the plating ability is shown by a mark ⊙.

From the above data, it can be seen that the steels I, II and III provide non-ageing steel sheets having very excellent formability and high plating ability.

What is claimed is:

1. A method for producing cold rolled steel sheets having a noticeably excellent formability, comprising preparing a steel consisting of not more than 0.008% of C, not more than 0.20% of Si, 0.04-0.30% of Mn, not more than 0.03% of P, 0.01-0.10% of Al, a content of Al being more than N%×4, not more than 0.02% of S, not more than 0.01% of N, 0.01-0.07% of Nb, a content of Nb being C%×3−{C%×8+0.02}%, and the remainder being substantially Fe, hot rolling the steel at a total reduction of not less than 90%, a rolling speed of not less than 40 m/min in finishing rolling and a finishing temperature of not lower than 830° C., coiling the hot rolled strip at a temperature of 600°-800° C., cold rolling the coiled strip to obtain a cold rolled strip having final gauge and then continuous annealing the cold rolled strip within a temperature range of 700°-900° C. for 10 seconds-5 minutes.

2. A method for producing cold rolled steel sheets having a noticeably excellent formability, comprising preparing a steel consisting of not more than 0.008% of C, not more than 0.20% of Si, 0.04-0.30% of Mn, not more than 0.03% of P, 0.01-0.10% of Al, a content of Al being more than N%×4, not more than 0.02% of S, not more than 0.01% of N, 0.01-0.07% of Nb, a content of Nb being C%×3−{C%×8+0.02}%, and the remainder being substantially Fe, hot rolling the steel at a total reduction of not less than 90%, a rolling speed of not less than 40 m/min in finishing rolling and a finishing temperature of not lower than 830° C., coiling the hot rolled strip at a temperature of 600°-800° C., cold rolling the coiled strip to obtain a cold rolled strip having final gauge and then continuous annealing the cold rolled strip within a temperature range of 700°-900° C. for 10 seconds-5 minutes and hot-dip galvanizing the thus treated strip continuously.

3. The method as claimed in claim 1 or 2, wherein a content of Nb is 0.01-0.05% and within a range of 4×C(%)~8×C(%)+0.010%.

4. The method as claimed in claim 1 or 2, wherein the content of C is not more than 0.006%.

5. The method as claimed in claim 1 or 2, wherein the coiling temperature is 680°-750° C.

6. The method as claimed in claim 1 or 2, wherein the cold rolling is effected at a reduction of 75-85%.

7. The method as claimed in claim 1 or 2, wherein the continuous annealing is effected at soaking at 780°-880° C. for 30-120 seconds.

8. The method as claimed in claim 1 or 2, wherein after the continuous annealing, a temper rolling is carried out at a reduction of less than 2%.

* * * * *